US012807374B2

(12) United States Patent
Thomasset et al.

(10) Patent No.: US 12,807,374 B2
(45) Date of Patent: Nov. 24, 2026

(54) PACKAGING AND PRODUCTION PROCESS

(71) Applicant: AISAPACK HOLDING SA, Vouvry (CH)

(72) Inventors: Jacques Thomasset, Neuvecelle (FR); Gilles Demaurex, Martigny (CH); Joachim Pellissier, Fully (CH)

(73) Assignee: AISAPACK HOLDING S.A., Vouvry (CH)

( * ) Notice: Subject to any disclaimer, the term of this patent is extended or adjusted under 35 U.S.C. 154(b) by 0 days.

(21) Appl. No.: 18/556,983

(22) PCT Filed: Apr. 22, 2022

(86) PCT No.: PCT/IB2022/053783
§ 371 (c)(1),
(2) Date: Oct. 24, 2023

(87) PCT Pub. No.: WO2022/229810
PCT Pub. Date: Nov. 3, 2022

(65) Prior Publication Data

US 2024/0199283 A1 Jun. 20, 2024

(30) Foreign Application Priority Data

Apr. 26, 2021 (EP) ..... 21170468

(51) Int. Cl.
*B65D 35/10* (2006.01)
*B65D 35/12* (2006.01)
(Continued)

(52) U.S. Cl.
CPC ..... *B65D 35/10* (2013.01); *B65D 35/12* (2013.01); *B65D 65/40* (2013.01); *B65D 65/466* (2013.01)

(58) Field of Classification Search
CPC ..... B65D 35/10; B65D 35/12; B65D 65/40; B65D 65/466
(Continued)

(56) References Cited

U.S. PATENT DOCUMENTS 2,119,926 A 6/1938 Quittner
3,260,411 A * 7/1966 Dobson ..... B65D 35/12 222/541.2
(Continued)

FOREIGN PATENT DOCUMENTS

CN 1068999 A 2/1993
CN 1324318 A 11/2001
(Continued)

OTHER PUBLICATIONS

International Search Report for PCT/IB2022/053783 dated Aug. 2, 2022, 3 pages.
(Continued)

*Primary Examiner* — Rafael A Ortiz
(74) *Attorney, Agent, or Firm* — NIXON & VANDERHYE

(57) ABSTRACT

The invention relates to a packaging part comprising a structural layer (2) based on cellulose and/or recycled material with an inner face, a section and an outer face, and a functional layer (4) covering the inner face of the structural layer (2) at least partly, the said functional layer (4) comprising an additional part (16) which extends beyond the periphery of the structural layer (2).

18 Claims, 9 Drawing Sheets

(51) Int. Cl.
*B65D 65/40* (2006.01)
*B65D 65/46* (2006.01)

(58) Field of Classification Search
USPC ..... 220/4.01, 635; 222/107
See application file for complete search history.

(56) References Cited

U.S. PATENT DOCUMENTS

| | | | | |
|---|---|---|---|---|
| 4,132,331 | A * | 1/1979 | Magerle | B29C 66/63 156/182 |
| 4,568,001 | A * | 2/1986 | Sander | B65D 35/12 222/541.2 |
| 5,292,034 | A * | 3/1994 | Keller | B29C 43/18 264/263 |
| 8,580,363 | B2 | 11/2013 | Thomasset et al. | |
| 8,852,705 | B2 | 10/2014 | Thomasset et al. | |
| 8,916,247 | B2 | 12/2014 | Thomasset | |
| 9,352,881 | B2 | 5/2016 | Medico et al. | |
| 2002/0079241 | A1* | 6/2002 | Matsuo | B65D 75/5883 206/277 |
| 2006/0157502 | A1 | 7/2006 | Meausoone et al. | |
| 2007/0187279 | A1 | 8/2007 | Zuppiger et al. | |
| 2015/0203256 | A1* | 7/2015 | Solle | B29B 17/00 29/403.1 |

FOREIGN PATENT DOCUMENTS

| | | | | |
|---|---|---|---|---|
| CN | 1968870 | A | 5/2007 | |
| DE | 527362 | * | 6/1931 | |
| DE | 527362 | C | 6/1931 | |
| EP | 0524897 | A1 | 1/1993 | |
| EP | 1260447 | A1 | 11/2002 | |
| EP | 2004389 | B1 | 1/2011 | |
| EP | 2007567 | B1 | 8/2011 | |
| EP | 2630052 | B1 | 7/2014 | |
| EP | 2004506 | B1 | 11/2017 | |
| FR | 2505250 | A1 | 11/1982 | |
| GB | 1118632 | A | 7/1968 | |
| GB | 1404993 | A | 9/1975 | |
| JP | 11-013019 | Y | 9/1936 | |
| JP | S5270647 | U | 5/1977 | |
| JP | S5481844 | U | 6/1979 | |
| JP | S59121345 | U | 8/1984 | |
| JP | S6089336 | A | 5/1985 | |
| JP | H0432947 | U | 3/1992 | |
| JP | H07137753 | A | 5/1995 | |
| JP | 2005297970 | A | 10/2005 | |
| JP | 2012091809 | A | 5/2012 | |
| WO | WO-0218221 | A1 * | 3/2002 | B65D 35/12 |
| WO | WO-2016163378 | A1 * | 10/2016 | B32B 27/34 |

OTHER PUBLICATIONS

Written Opinion of the ISA for PCT/IB2022/053783 dated Aug. 2, 2022, 6 pages.

Office Action, issued in Chinese Patent Application No. 202280029697.8 dated Aug. 14, 2025.

Office Action, issued in Japanese Patent Application No. 2023-563879 dated Oct. 7, 2025.

Office Action, issued in Japanese Patent Application No. 2023-563879 dated Jun. 30, 2026.

* cited by examiner

PACKAGING AND PRODUCTION PROCESS

CROSS-REFERENCE TO RELATED APPLICATIONS

This application is the U.S. national phase of International Application No. PCT/IB2022/053783 filed Apr. 22, 2022 which designated the U.S. and claims priority to European Application No. 21170468.9 filed Apr. 26, 2021, the entire contents of each of which are hereby incorporated by reference.

TECHNICAL FIELD

The invention relates to the field of packaging based on cellulose or recyclable plastic. More specifically, it concerns packaging comprising a tubular body obtained by welding or gluing end-to-end of a sheet. The invention applies in the field of packaging, and in particular that of recyclable flexible tubes which are designed to contain cream or paste products; or it applies in that of flexible pouches to contain foodstuffs; or that of cans as a replacement for aluminium, to contain liquids; or that of containers for cosmetic products.

PRIOR ART

Patent EP1260447B1 by Otani describes paper pulp packaging produced by moulding. The Otani patent has numerous advantages, since it makes it possible to obtain packaging with a high level of cellulose. The process according to Otani makes it possible in particular to form packages with threads which have substantial strength and durability. However, the process for obtaining this packaging has a long cycle time which does not permit production at a fast pace and at a competitive cost. Furthermore, the process does not make it possible to modulate locally the thickness of the packaging, which is detrimental when wishing to produce flexible packaging such as tubes for example.

Plastic, or metal-plastic, or paper-plastic tubes produced by welding a tubular body onto a tube head, such as flexible tubes, are described for example in the publications FR2505250, GB1118632, U.S. Pat. Nos. 2,119,926 and 4,132,331. The problem of leakage at the intersection of the welds is not approached in these documents, since the tubes described in these publications mostly have plastic or synthetic material which melts at least partly or completely during the welding operation and prevents the formation of cavities. However, the prior art does not teach how to obtain sealed packaging when using mostly materials based on cellulose or other equivalent (natural or synthetic) materials which do not melt under the effect of the temperature.

SUMMARY AND PRINCIPLE OF THE INVENTION

An objective of the invention is to improve the known processes, machines and products.

Another objective of the invention is to improve the packaging based on cellulose, and the processes and the machines for their production.

Another objective of the invention is to improve the packaging based on recycled material(s) which can not be in contact with the packaged product, and the processes and machines for their production.

Another objective of the invention is to eliminate the problems of sealing encountered with the tubes and packaging according to the prior art, the parts of which are made of materials based on cellulose.

The invention relates to packaging based on cellulose and/or recycled material(s) comprising a tubular body assembled on at least one component forming the end of a tube or a container or a bottle. This component is for example a shoulder with a neck and/or a base.

According to some embodiments, the invention makes it possible to produce packaging based on cellulose containing a level of cellulose which is sufficient to permit its recycling in the channel for paper and/or other recycled material(s), thus allowing it to be recycled via an appropriate channel. The tubular packaging body which is produced by welding a sheet based on cellulose can contain a high level of cellulose, typically higher than 85%. However, the production of components (necks, bases) which contain a high level of cellulose continues to be a topical subject.

Hereinafter in the description of the invention, the term "recycled material" will be used to designate materials which are not suitable for coming into contact with the packaged product. For example, a recycled material can be a recycled resin, or a recycled plastic material, such as HDPE, or other equivalents. The recycled material can be a single material or need not be, i.e. it can comprise a plurality of materials (traces, pollution, etc.). Other materials which are not necessarily recycled, but which are not suitable for being in contact with the packaged product, can also be envisaged within the context of the present invention.

According to other embodiments, the invention makes it possible to produce packaging based on recycled material(s) with a level higher than 60% and preferably higher than 85%. The tubular body of the packaging which is produced by welding a sheet based on recycled material can contain a level of recycling which is typically higher than 85%. However, the production of components (necks, bases) which contain a high level of recycled material (not suitable for being in contact with the packaged product) also continues to be a topical subject.

The invention relates to a component (such as, for example, a tube head or base) based on cellulose or recycled material comprising a functional layer which is (preferably) thin, covering at least the so-called inner face of the said component, its section at the end of the said component, as well as its so-called assembly area. The inner face of the component is defined as the face of the component which is in the interior of the packaging, and is in contact with the packaged product. The section is the part of the component which forms the end thereof, and is situated in the interior of the packaging after assembly. The assembly area is defined by the part of the outer face of the component which is situated on the periphery, and is used to assemble the component and the tubular body of the packaging. According to some embodiments of the invention, the end of the inner face of the tubular body is assembled on the end of the outer face of the component. Preferably, the assembly is carried out by welding.

According to the invention, the functional layer is a single layer, or itself contains a plurality of layers in order to ensure that all of the properties are provided (for example barrier, weldability, organoleptic).

According to the invention, the functional layer has at least properties of impermeability which protect the layer of cellulose (known as the "structural layer") against the humidity contained in the packaging and/or in the packaged product, and guarantee the preservation of the packaged product. The functional layer can also have properties of impermeability to gases, such as oxygen, in order to prevent oxidation of the packaged products.

According to the invention, the functional layer has at least properties of impermeability which isolate the layer made of recycled material (known as the "structural layer") of the packaged product, and prevent migration of molecules from the layer made of recycled material to the packaged product, and guarantee the preservation of the packaged product. The functional layer preferably has properties of impermeability to gases, such as oxygen, in order to prevent oxidation of the packaged products and migration of recycling residues.

The functional layer has properties which permit assembly of the component on the tubular body. Preferably, the functional layer has properties of weldability with the inner layer of the tubular body. Alternatively, the functional layer is assembled by gluing or another similar and/or equivalent method.

According to another embodiment of the invention, the functional layer covers all of the surface of the component, i.e. its inner surface, its outer surface, as well as its section. This variant makes it possible to obtain packaging which is insensitive to humidity, i.e. both coming from the interior of the packaging (liquid packaged product) and from the environment in which the packaging is used (bathroom, shower, for example).

Processes for production of these components and packaging comprising such components according to the invention are described in the present application.

The process for production of the components comprises at least the following steps:

1. Assembly of the functional layer on the inner face of the component based on cellulose or recycled material;
2. Covering of the section by the functional layer;
3. Assembly of the functional layer on the outer face of the component based on cellulose or recycled material at least at the so-called assembly area.

According to some embodiments, the invention relates to a packaging part, the said part comprising a structural layer based on cellulose or recycled material with an inner face, a section and an outer face, and a functional layer covering the inner face of the structural layer at least partly, the said functional layer comprising an additional part which extends beyond the periphery of the structural layer.

According to some embodiments, the packaging part comprises a functional layer covering the outer face of the structural layer at least partly.

According to some embodiments, the functional part is formed by the part of the functional layer covering the inner face and the outer face, and extending beyond the periphery of the structural layer.

According to some embodiments, the additional part can be at least partly cut.

According to some embodiments, the additional part can be folded back in order to cover the section of the structural layer.

According to some embodiments the functional layer has welding properties.

According to some embodiments, the functional layer is single-layer or multiple-layer.

According to some embodiments, the functional layer is for example made of:

PE/EVOH/PE
PVOH
PVOH/PE
PP/metallised BOPP/PP
PP/SiOX BOPP/PP or is based on biodegradable and/or bio-sourced resins, or combinations of materials.

According to some embodiments, the structural layer is single-layer or multiple-layer.

According to some embodiments, the packaging part is a tube head or a base.

According to some embodiments, the packaging part is a tube head comprising a neck.

According to some embodiments, the neck is clipped onto the tube head.

According to some embodiments, the packaging part comprises a stopper.

According to some embodiments, the packaging part comprises an element for connection between the neck and the stopper.

According to some embodiments, the functional layer obstructs the orifice of the neck at least partly or totally.

According to some embodiments, the invention relates to packaging comprising at least a part as described in the present application, in the form of a tube head and/or base, and a second part in the form of a tubular body with a functional layer, the said parts being secured to one another in an assembly area comprising the functional layer of each part, in order to ensure the continuity of the said functional layers after assembly of the said parts.

According to some embodiments of the packaging, the assembly of the parts is carried out by welding or gluing.

According to some embodiments, the packaging is a tube or a container for example.

In some embodiments according to the invention of a process for production of a first part of an item of packaging (such as a shoulder or a base) comprising at least the said first part and a second part (such as a tubular body), which are designed to be assembled to one another by securing at an assembly area, with the said first part comprising a structural layer based on cellulose or recycled material with an inner face, a section and an outer face, in the process a functional layer is attached to the structural layer by covering at least the inner face of the structural layer and forming an additional part which extends beyond the periphery of the structural layer, and the additional part is folded back such as to cover at least the section of the structural layer.

According to some embodiments of the process, a supplementary fold is produced in the additional part, such as to turn it down and secure it on the outer surface of the structural layer of the first part, the said additional part forming the area of assembly of the parts of the packaging.

According to some embodiments of the process, the outer face of the structural layer of the first part is also covered with a functional layer, such as to encapsulate the first part in the functional layer.

According to some embodiments of the process, the additional part is formed by means of the functional layer covering the inner face and/or of the functional layer covering the outer face of the first part.

According to some embodiments of the process, the additional part is cut at least partly.

According to some embodiments of the process, a packaging is formed by assembling at least the first part and the second part, and attaching them to one another in the assembly area.

According to some embodiments of the process, the first part is a shoulder and/or a base, and the second part is a tubular body. According to one embodiment of the process, in order to form a container, the packaging comprises three parts, i.e. a shoulder as the first part, a tubular body as the second part, and a base as the third part. These parts are assembled according to the steps of the process as described in the present application, the first part and the third part being assembled with the second part for example as illustrated in the figures.

NUMERICAL REFERENCES

Figure 1:
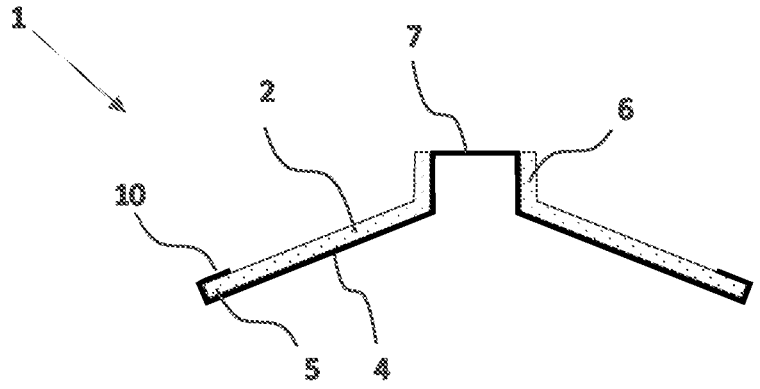
FIGS. 1 to 6 illustrate packaging components and packaging based on cellulose or recycled material corresponding to the invention.

1: tube head or shoulder (component)
2: structural layout based on cellulose or recycled material
3: tubular body based on cellulose or recycled material
4: functional layer
5: end
6: neck
7: orifice
8: hot air
9: base (component)
10: assembly area
11*a*: clipped-on part
11*b*: connection element
11*c*: stopper
12: end
13: end weld
14: longitudinal weld
15: stopper
16: additional part In the description of the invention, the term "structural layer" 2 is used to designate the part of the component (such as a tube head/shoulder 1 or a base 9) based on cellulose or recycled material representing most of the mass thereof, and on which the mechanical strength thereof is mainly dependent. According to the invention, this structural part can itself be composed of a plurality of layers (for example at least two layers). Advantageously, the structural layer 2 is composed of a plurality of layers based on cellulose fibres, each layer being able to be characterised by the size, orientation and density of the fibres.

In the description of the invention, the term "functional layer" 4 is used to designate a layer with a narrow thickness which provides the functionality of the packaging, such as the barrier against humidity, aromas or oxygen, such as the suitability for contact with the packaged product, and such as the weldability in the area of assembly with the tubular body. According to the invention, this layer can itself be composed of a plurality of layers in order to provide all of the functionalities required.

In the description of the invention, the inner face represents the face of the component which is situated in the interior of the packaging, and is potentially in contact with the product contained in the packaging. On the contrary, the outer face represents the face which is situated on the exterior of the packaging.

In the description of the invention, the term "end" is used to designate the part of the component which is situated on the periphery at the section. Within the context of the invention, it is important to cover the end of the component with the functional layer 4, since the said end is in the interior of the packaging after assembly on the tubular body 3.

FIG. 1 illustrates a shoulder 1 of a tube or container comprising a level of cellulose or recycled material which is higher than 70% and preferably higher than 85%. According to the invention, the shoulder 1 illustrated in FIG. 1 comprises a structural layer 2 based on cellulose or recycled material, and functional layer 4 covering at least the inner face of the shoulder 1, the end 5 of the shoulder 1, and the assembly area 10 of the shoulder 1.

FIG. 1 illustrates a shoulder 1 with a neck 6 which makes it possible to associate means for opening-closure, such as a stopper, by screwing, clipping-on or welding. The orifice of the neck 7 is obstructed by the functional layer 4, which can be pierced during the first use in order to permit extraction of the packaged product. The solutions for perforation by a stopper are already known and disclosed in the prior art. According to a variant not illustrated, the functional layer 4 does not obstruct the orifice 7.

The shoulder 1 can also be associated with complex elements for extraction of the product, such as pumps which make it possible to measure out the product extracted from the packaging.

The functional layer 4 makes it possible to provide the properties necessary at the shoulder 1 for preservation of the packaged product, and in conjunction makes it possible to protect the structural layer 2 based on cellulose or recycled material against any deterioration caused by the packaged product. For example, when the packaged product is water-based, the functional layer 4 makes it possible to protect the structural layer 2 against the humidity contained in the packaging and/or in the packaged product. The protection of the section of the structural layer 2 based on cellulose at the end 5 is a key point of the invention.

Figure 2:
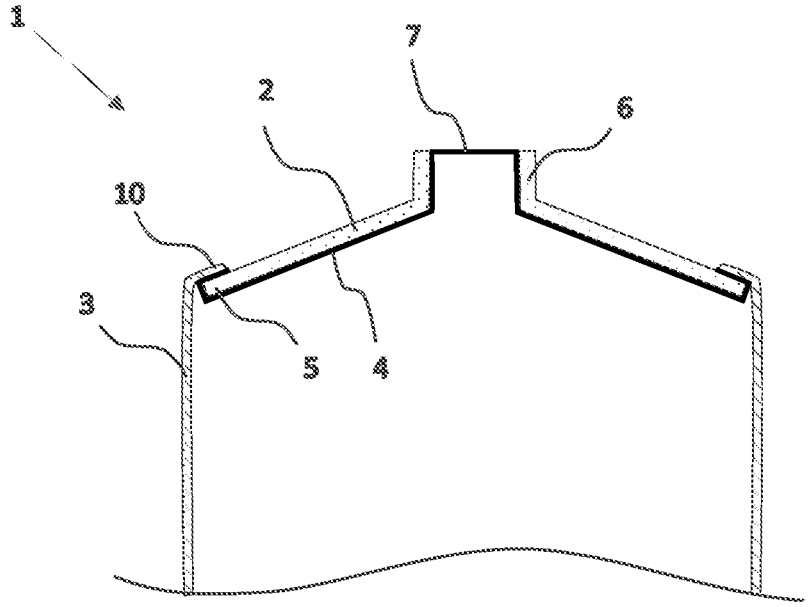

FIG. 2 illustrates the assembly of the shoulder 1 on the tubular body of the packaging, the said packaging being for example a tube or a container.

The structure and production of the tubular body 3 based on cellulose or recycled material is not described in the invention, since these are already described in the prior art and in particular in the publications EP2007567, EP284389, EP2630052. The tubular bodies 3 based on cellulose or recycled material advantageously comprise at least one structural layer based on cellulose or recycled material, and a functional layer situated at least on the inner face of the tubular body, the barrier properties of which depend on the packaged product (for example barrier against humidity and/or oxygen and/or aromas). The functional layer in the interior of the packaging is in contact with the packaged product. The said structural and functional layers generally comprise a plurality of layers. The tubular body 3 based on cellulose is advantageously produced from a multiple-layer sheet, the ends of which are assembled end-to-end, preferably with the addition of reinforcement strips at the assembly position. Alternatively, the tubular body is produced by covering edges of the sheet based on cellulose or recycled material.

The assembly between the end of the shoulder 1 and the end of the tubular body 3 is carried out at the assembly area 10. In this area, the inner face of the tubular body 3 is superimposed on the outer face of the shoulder 1, such that the inner functional layer of the tubular body 3 is directly in contact with the functional layer 1 of the shoulder 1. The invention thus permits continuity of the functional layers between the shoulder 1 and the tubular body 3 at the assembly area 10, thus guaranteeing the continuity of the barrier properties of the packaging. The assembly between the shoulder 1 and the tubular body 3 is preferably carried out by welding. An alternative method consists of carrying out the assembly by gluing. It will be appreciated that other, equivalent methods are possible and can be envisaged.

Figure 3:
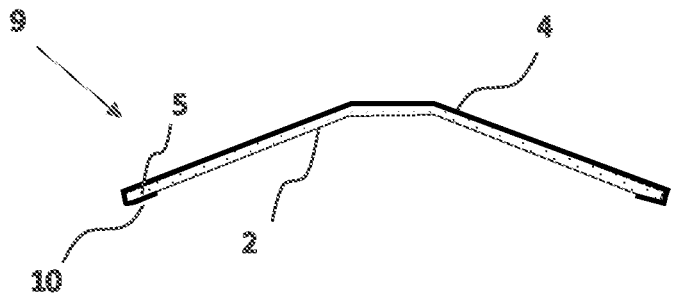

FIG. 3 illustrates a component in the form of a packaging base 9 based on cellulose according to the invention. The base 9 comprises a level of cellulose or recycled material which is higher than 70% and preferably higher than 85%. The base 9 comprises at least one structural layer 2 based on cellulose or recycled material, and a functional layer 4 covering the inner face of the base, the end 5, and the assembly area 10.

The functional layer 4 makes it possible to provide the properties necessary at the base for preservation of the packaged product, and in conjunction it makes it possible to protect the structural layer 2 based on cellulose against any deterioration caused by the packaged product. For example, when the packaged product is water-based, the functional layer 4 makes it possible to protect the structural layer 2 against the humidity contained in the packaging and/or in the packaged product. The protection of the section of the layer 2 based on cellulose at the end 5 is a key point of the invention.

Figure 4:
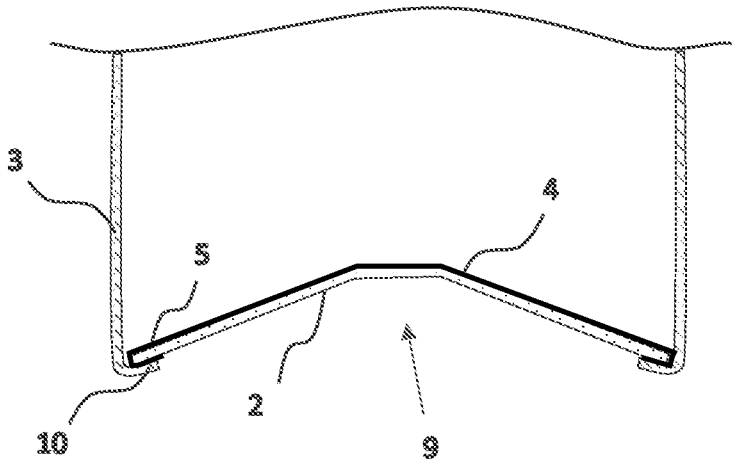

FIG. 4 illustrates the assembly of the base 9 on the tubular body 3 of the packaging, the said packaging being for example a container or a bottle.

FIG. 4 shows that the inner face of the base 9 (upper face in FIG. 3) is in the interior of the packaging after assembly with the tubular body 3.

The assembly between the end of the base 9 and the end of the tubular body 3 is carried out at the assembly area 10. In this area, the inner face of the tubular body is superimposed on the outer face of the base, such that the inner functional layer of the tubular body 3 is directly in contact with the functional layer 4 of the base. The invention thus permits continuity of the functional layers between the base 9 and the tubular body 3 at the assembly area 10, therefore guaranteeing the continuity of the barrier properties of the packaging. The assembly between the base 9 and the tubular body 3 is preferably carried out by welding. An alternative method consists of carrying out the assembly by gluing. It will be appreciated that other, equivalent methods are possible and can be envisaged.

Figure 5:
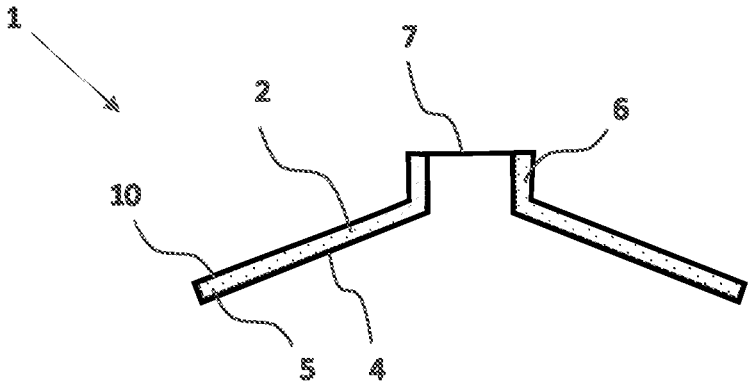
Figure 6:
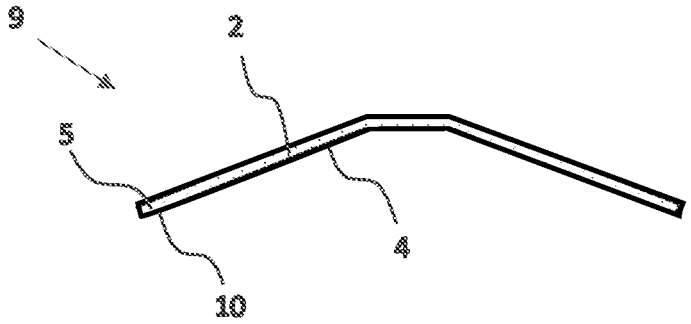

FIGS. 5 and 6 illustrate a second embodiment of the invention, according to which the functional layer 4 encapsulates totally the structural layer 2 based on cellulose or recycled material, i.e. its inner surface, its outer surface, as well as the section 5, 10. This embodiment of the invention makes it possible to obtain packaging which is insensitive to humidity, i.e. both that coming from the interior of the packaging (liquid packaged product) and from the environment in which the packaging is used (bathroom, shower).

FIG. 5 illustrates a packaging shoulder 1 corresponding to the second embodiment of the invention. The shoulder 1 comprises a structural layer 2 based on cellulose or recycled material which is totally encapsulated under the functional layer 4. The total encapsulation of the structural layer based on cellulose makes it possible to protect the layer of cellulose against the humidity coming from the interior or the exterior of the packaging. The covering of the outer face of the structural layer 2 based on cellulose by the functional layer 4 makes it possible to prevent the migration of products in the liquid or gaseous state into the structural layer, which would have the effect of degrading its properties.

FIG. 6 illustrates a packaging base 9 corresponding to the second embodiment of the invention. The structural layer 2 based on cellulose or recycled material is totally encapsulated in the thin functional layer 4.

The functional layer 4 can be single-layer or multiple-layer. Examples of structures of the functional layer 4 are as follows:

PE/EVOH/PE
PVOH
PVOH/PE
PP/metallised BOPP/PP
PP/SiOX BOPP/PP

The layer 4 can be based on biodegradable and/or bio-sourced resins, or combinations of materials.

Alternatively, the functional layer 4 can be based on natural or synthetic products applied by spraying (spray coating) or dipping (dip coating) directly onto the structural layer 2 based on cellulose.

Figure 7:
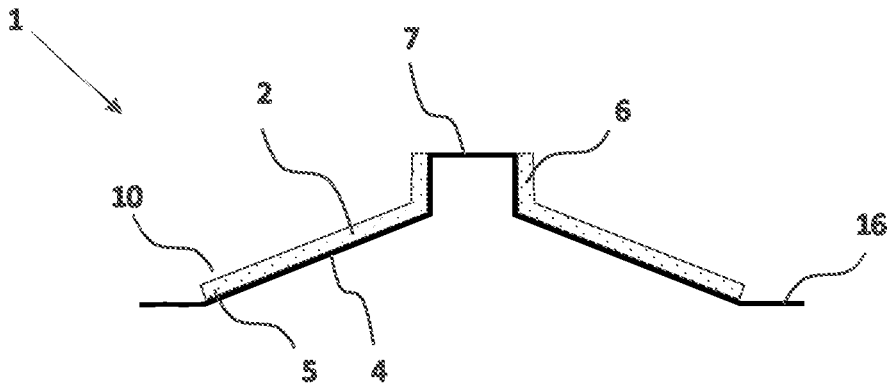
FIGS. 7 to 18 illustrate processes for production of the packaging components and packaging according to the invention.
Figure 8:
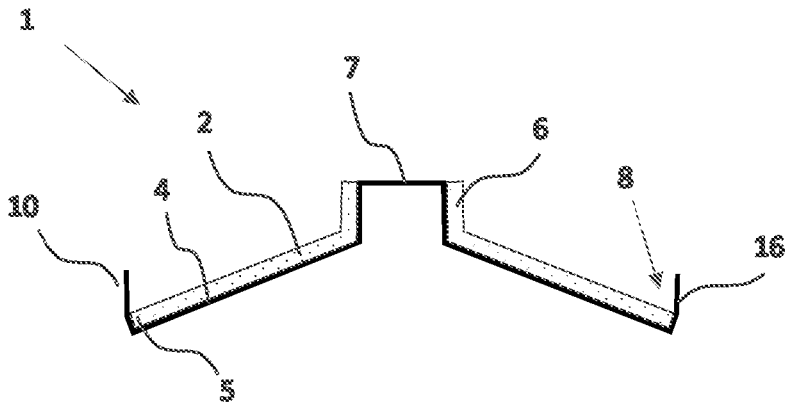
Figure 9:
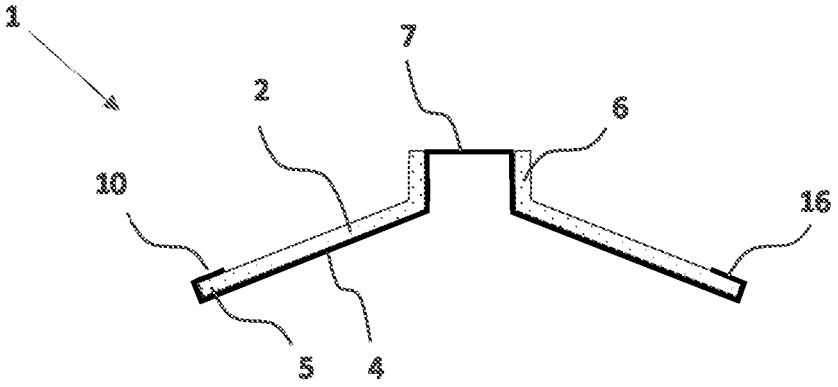

FIGS. 7 to 9 illustrate a first example of a production process according to the invention when the layer 4 is in the form of a prefabricated film.

The first step of the process, illustrated in FIG. 7, consists of securing the functional layer 4 by welding or gluing onto the inner face of the structural layer 2. As illustrated in FIG. 7, the functional layer 4 has an additional part 16 which extends beyond the periphery of the structural layer 2.

The second step illustrated in FIG. 8 consists of folding the additional part 16 of the functional layer 4 in order to cover the section of the structural layer 2 based on cellulose or recycled material. Optionally, the functional layer 4 is secured by welding or gluing onto the section of the structural layer 2.

Finally, the third step of the process illustrated in FIG. 9 consists of forming a new fold in the additional part 16 in order to turn down the said additional part 16 against the outer surface of the structural layer 2 based on cellulose or recycled material, and in order to secure the additional part 16 on the structural layer 2 by welding or gluing. The additional part 16 of the functional layer forms the area of assembly 10 on the periphery of the shoulder 1.

The functional layer 4 is preferably secured by welding on the structural layer 2 based on cellulose or recycled material. In addition, for example, welding by means of hot air of the additional part 16 can be envisaged. FIG. 8 illustrates blowing of a flow of hot air 8 at the interface to be welded of the structural layer 2 and the additional part 16. Methods of welding by ultrasound or by heating pad can also be used.

According to another embodiment of the invention, the functional layer 4 is secured only locally on the structural part 2.

FIGS. 10 to 12*b* illustrate a second embodiment of a process for the production of components (such as a tube head 1 or a base 9) having a structural layer 2 which is completely encapsulated in the functional layer 4. In this example, the functional layer 2 is in the form of a prefabricated film.

Figure 10:
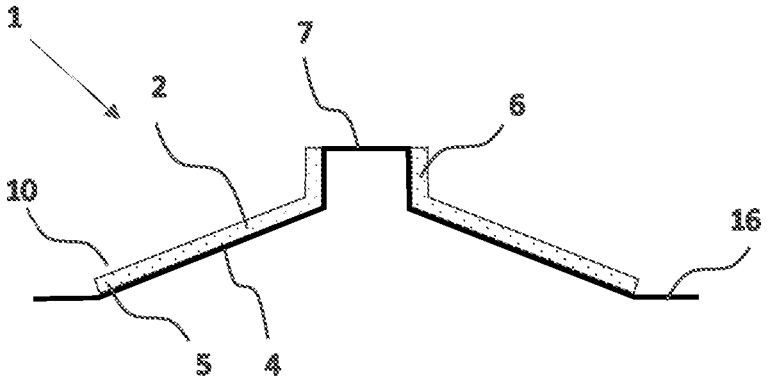

The first step of this process illustrated in FIG. 10 consists of securing the functional layer 4 on the inner face of the structural layer 2 based on cellulose or recycled material. As illustrated in FIG. 10, the functional layer 4 has an additional part 16 which extends beyond the periphery of the structural layer 2.

Figure 11:
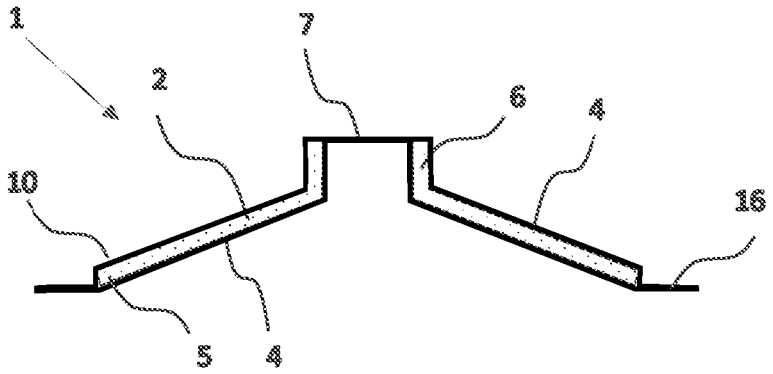

The second step of the process illustrated in FIG. 11 consists of securing another functional layer 4 on the outer face of the structural layer 2 and simultaneously (or subsequently) securing the inner and outer functional layers together at the additional part 16, in order to encapsulate the structural layer 2.

Figure 12A:
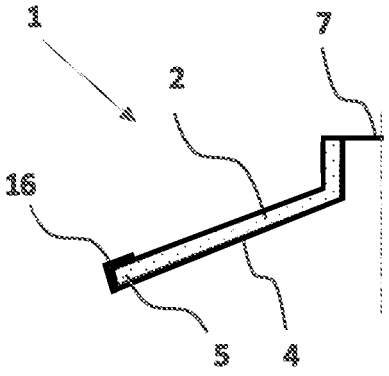
Figure 12B:
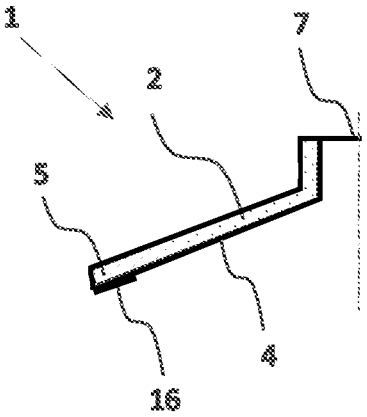

The third step of the process consists of cutting the supplementary part 16 which is unnecessary and/or to be folded, and securing the supplementary part 16 (or a part thereof after the cutting) on the outer (FIG. 12*a*) or inner (FIG. 12*b*) wall of the component (1 or 9), in order to obtain the component illustrated in FIGS. 12*a* and 12*b*.

According to another embodiment, not illustrated, the first process is carried out in order to obtain the component illustrated in FIG. 9, then the functional layer 4 is added onto the upper face of the component 1, and the functional layers are covered in the assembly area 10, in order to encapsulate totally the structural layer 2 based on cellulose or recycled material.

According to another embodiment of a process according to the invention, the functional layer 4 can be extruded directly onto the structural layer 2 based on cellulose or recycled material.

According to another embodiment of a process according to the invention, the functional layer 4 is deposited by spraying (spray coating) or by dipping (dip coating).

Figure 13:
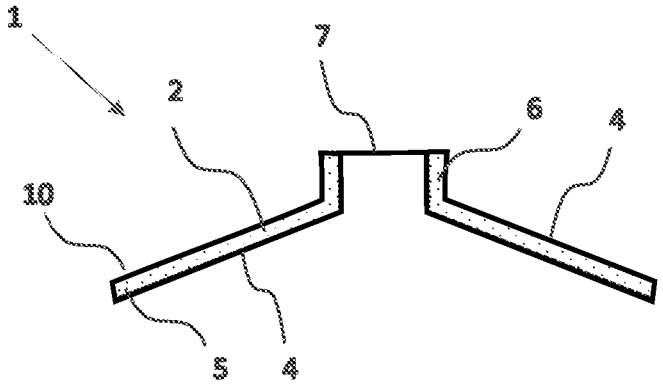

FIG. 13 illustrates an embodiment in which the orifice 7 of the neck 6 is obstructed by the functional layer 4 applied on the outer face of the component (such as a shoulder 1). The functional layer 4 can be pierced during the first use in order to permit extraction of the packaged product.

Figure 14:
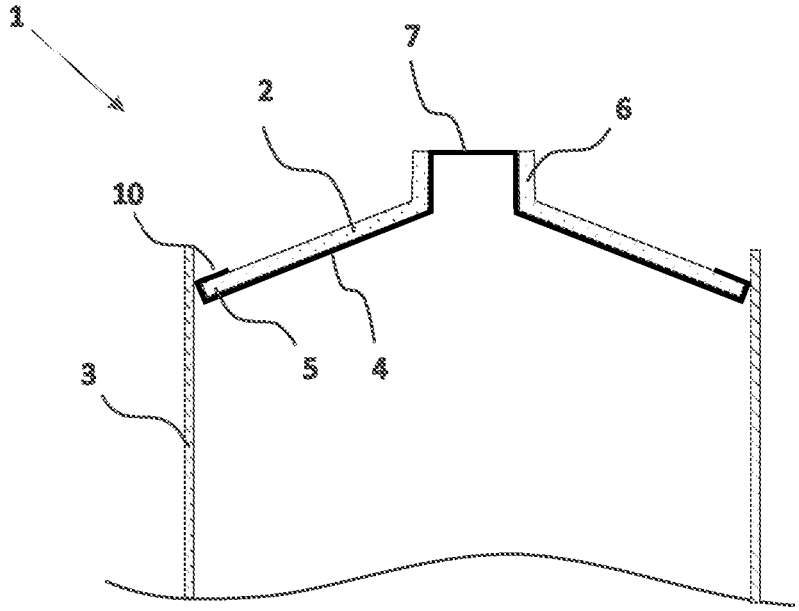

FIGS. 14 to 17 illustrate examples of a process for assembly of the components (such as a shoulder 1 and/or a tubular body 3) based on cellulose or recycled material, on the tubular body 3. The preferred process is illustrated in FIGS. 13 and 14.

FIG. 14 illustrates the relative positioning of the tubular body 3 and the component 1 (for example a shoulder) before their assembly. In this step, the interface to be assembled of the tubular body 3 and/or of the component 1 can be subjected to a heating or gluing operation, according to the assembly mode selected. Heating by means of hot air is preferably used when the two parts 1 and 3 are assembled by welding.

Figure 15:
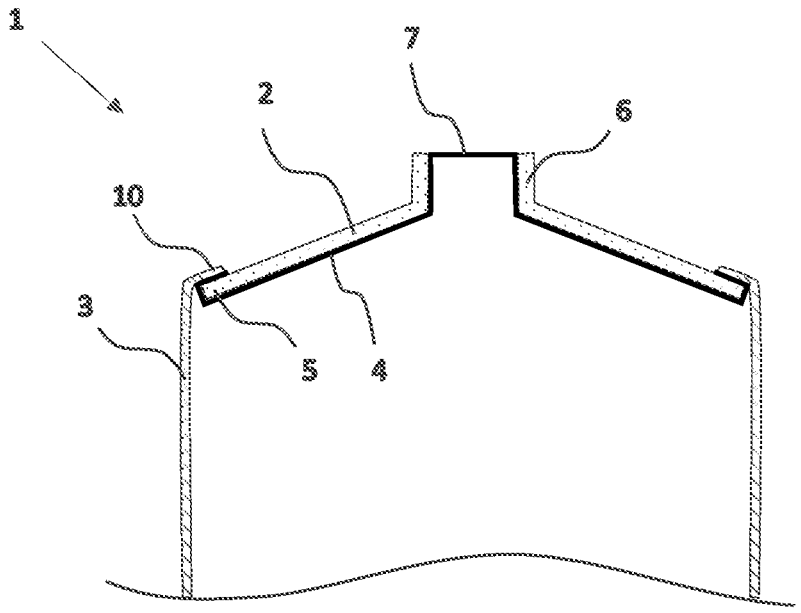

FIG. 15 illustrates the second step of the process in which the inner surface of the tubular body is pressed against the outer surface of the component 1 in the assembly area 10, in order to carry out the assembly by gluing or welding.

Figure 16:
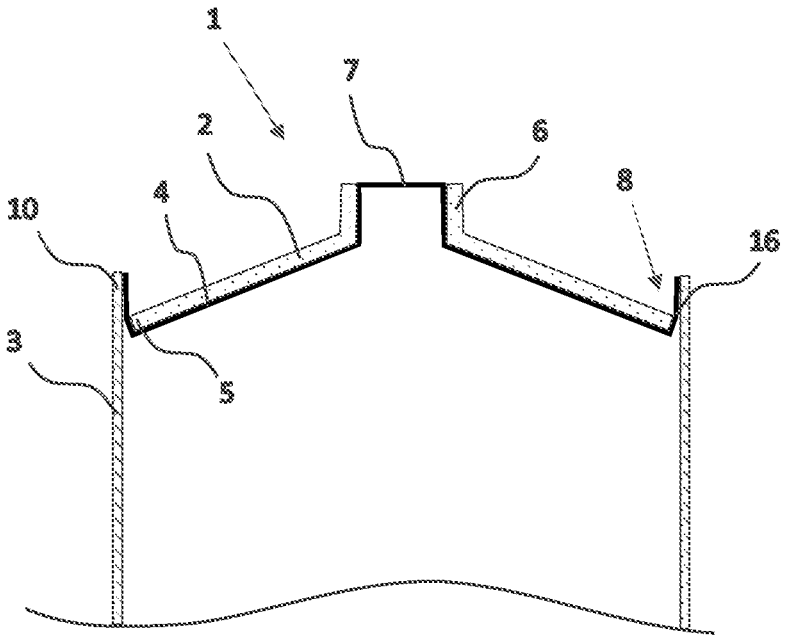
Figure 17:
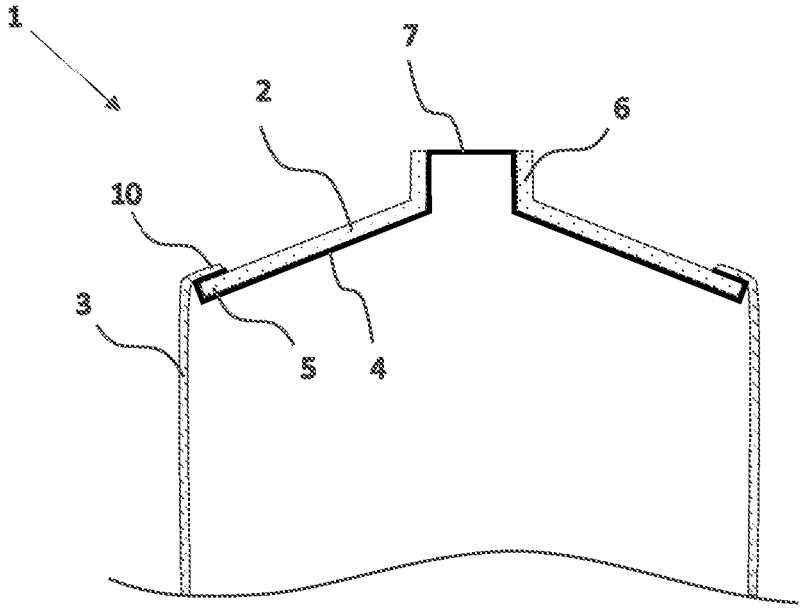

FIGS. 16 and 17 illustrate another process for assembly of the tubular body 3 and the component 1 (for example a shoulder). According to this other mode, the supplementary part 16 of the functional layer 2 is turned down and secured on the outer face of the component 1 at the moment of assembly.

FIG. 16 illustrates the first step of the process, with the additional part 16 which is folded by the tubular body 3 positioned around the component 1. Heating by means of a flow of hot air 8 makes it possible to heat in conjunction the interface to be welded of the component, the interface to be welded of the tubular body 3, and the supplementary part 16 of the functional layer 4.

FIG. 17 illustrates the second step of the assembly process, which consists of pressing and cooling the assembly area 10. As indicated in the present description, the assembly can be carried out by welding, gluing, or another method.

It will be appreciated that the above-described assembly process applies in a corresponding manner to other components such as, for example, a base 9 as represented in FIGS. 3, 4, 6.

Figure 18:
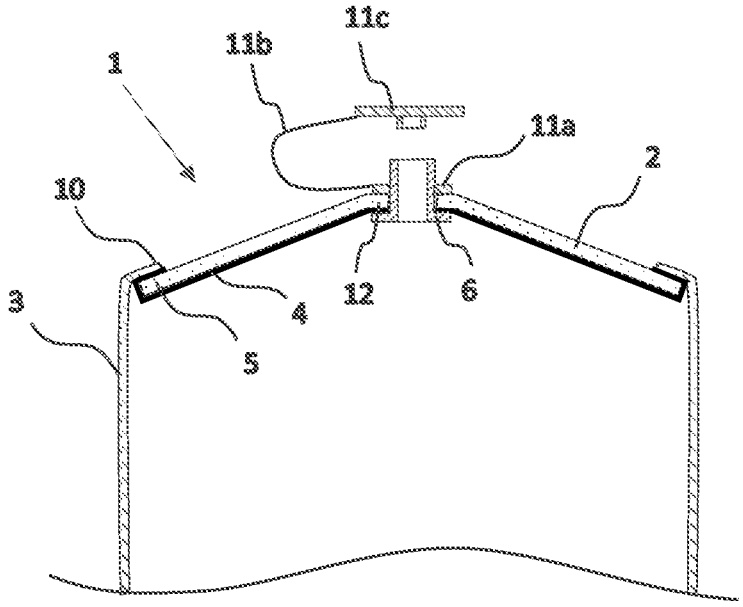

FIG. 18 illustrates another embodiment of the invention according to which a neck 6 is assembled by being clipped onto a shoulder or head 1 of a tube based on cellulose. The operation of clipping or snapping on ensures the sealing of the connection, and makes it possible to protect the end 12 of the shoulder 1. During the clipping-on operation, the end 12 of the shoulder 1 is gripped between the neck 6 and the clipped-on part 11*a*. In the example illustrated in FIG. 3, the clipped-on part 11*a* is connected to a stopper 11*c* by means of a connection element 11*b*. The connection element 11*b* makes it possible to prevent the stopper 11*c* from becoming separated from the packaging, which facilitates the recycling operations and makes it possible to comply with the statutory requirements.

The connection element 11*b* can for example be a wire element or a hinge or another equivalent structure.

The clipped-on elements 11*a* have a geometry suitable for ensuring sealing of the packaging after clipping on has taken place.

The advantage of clipping on is the speed of assembly on the production lines, and optionally the possibility of separating the clipped-on parts 11*a* from the remainder of the packaging during recycling. The principle of clipping on of the neck 6 is not limited to the embodiments illustrated in FIG. 18, but can be applied to all the packaging described in the present application, or to other packaging with different forms, materials and structures.

In embodiments of the packaging according to the present invention:

The stopper can be a cap.

The stopper can be clipped on.

The stopper can be screwed on.

The stopper can be pushed into the neck.

The stopper can comprise a hinge.

The stopper is preferably secured on the packaging.

Figure 19:
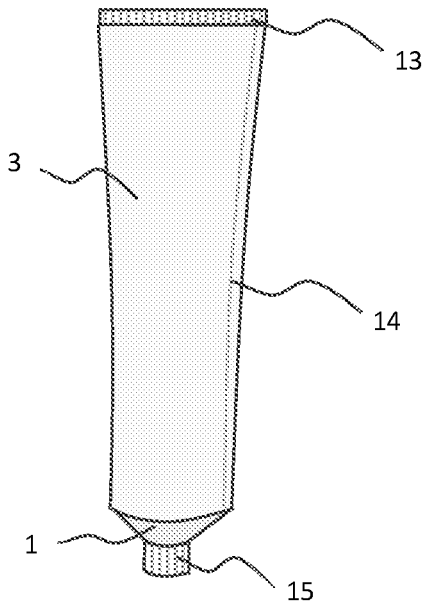
FIGS. 19 to 20 illustrate examples of packaging which can be produced by applying the principle of the invention.
Figure 20:
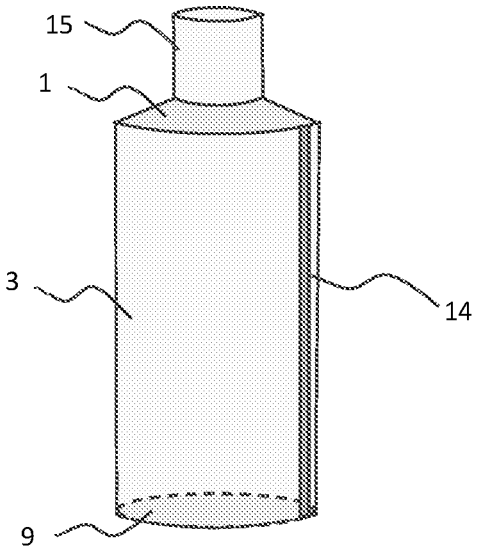

FIGS. 19 and 20 illustrate non-limiting examples of packaging produced according to the principles of the invention. This packaging can be tubes as illustrated in FIG. 19, or containers or bottles as illustrated in FIG. 20, with a stopper 15 which can be the one illustrated in FIG. 18 (references 11*a*-11*c*).

The invention can be applied to the packaging illustrated in the present application (tubes, containers) or to other types of packaging not represented. The embodiments in the present application are described by way of illustrative examples, and they must not be considered as limiting. Other embodiments can use means equivalent to those described, for example. The embodiments can also be combined with one another according to the circumstances, or means used in one mode can be used in another mode.

The invention claimed is:

1. A packaging comprising:

at least one packaging part comprising a structural layer having a periphery and being based on cellulose or recycled material, the structural layer including an inner face, a section that is an end of the at least one packaging part, and an outer face;

a first functional layer at least partly covering the inner face of the structural layer, the first functional layer comprising an additional part which extends beyond the periphery of the structural layer, the additional part of the first functional layer sitting directly on top of the periphery of the structural layer at the outer face; and a tubular body comprising a second functional layer, the tubular body having an end sitting directly on top of the additional part of the first functional layer, wherein the at least one packaging part is secured to the tubular body in an assembly area in which the first functional layer is in contact with the second functional layer.

2. The packaging settaccording to claim 1, wherein the at least one packaging part further comprises another functional layer covering the outer face of the structural layer at least partly.

3. The packaging according to claim 2, wherein the additional part is formed by the part of the functional layer covering the inner face and the outer face and extending beyond the periphery of the structural layer.

4. The packaging according to claim 1, wherein the additional part is at least partly cut.

5. The packaging according to claim 1, wherein the additional part is folded back in order to cover the section of the structural layer.

6. The packaging according to claim 1, wherein the functional layer has welding properties.

7. The packaging according to claim 1, wherein the functional layers are single layer or multiple-layer.

8. The packaging according to claim 1, wherein the functional layers are made of one of:

PE/EVOH/PE,

PVOH,

PVOH/PE,

PP/metallized BOPP/PP,

PP/SiOX BOPP/PP, based on biodegradable and/or bio-sourced resins, and combinations of materials.

9. The packaging according to claim 1, wherein the structural layer is one of a single-layer and a multiple-layer.

10. The packaging according to claim 1, wherein the at least one packaging part is one of a tube head and a base.

11. The packaging according to claim 1, wherein the at least one packaging part is a tube head comprising a neck.

12. A packaging comprising:

at least one packaging part comprising a structural layer having a periphery and being based on cellulose or recycled material, the at least one packaging part being a tube head comprising a neck is clipped onto the tube head, the structural layer including an inner face, a section that is an end of the at least one packaging part, and an outer face;

a first functional layer at least partly covering the inner face of the structural layer, the first functional layer comprising an additional part which extends beyond the periphery of the structural layer; and a tubular body comprising a second functional layer, wherein the at least one packaging part is secured to the tubular body in an assembly area in which the first functional layer is in contact with the second functional layer.

13. The packaging according to claim 11, wherein the at least one packaging part comprises a stopper.

14. The packaging according to claim 13, further comprising a connection element between the neck and the stopper.

15. The packaging according to claim 1, wherein the functional layer obstructs an orifice of the neck.

16. The packaging according to claim 1, wherein the assembly is carried out by welding or gluing.

17. The packaging according to claim 1, wherein the packaging is one of a tube and a container.

18. The packaging according to claim 11, wherein the neck is clipped onto the tube head.

* * * * *